United States Patent [19]

Villalobos

[11] Patent Number: 4,665,631

[45] Date of Patent: May 19, 1987

[54] AIR SEALING NOZZLE FOR HIGH SPEED DRYER

[75] Inventor: Joseph A. Villalobos, Mahwah, N.J.

[73] Assignee: Thermo Electron Web Systems, Inc., Auburn, Mass.

[21] Appl. No.: 842,126

[22] Filed: Mar. 20, 1986

Related U.S. Application Data

[63] Continuation-in-part of Ser. No. 732,935, May 13, 1985, abandoned.

[51] Int. Cl.[4] ..... F26B 13/08

[52] U.S. Cl. ..... 34/114; 34/116; 34/117; 34/123

[58] Field of Search ..... 34/114, 116, 117, 123

[56] References Cited

U.S. PATENT DOCUMENTS 4,502,231 3/1985 Fissmann et al. ..... 34/116

*Primary Examiner*—Larry I. Schwartz

*Attorney, Agent, or Firm*—Shenier & O'Connor

[57] ABSTRACT

An assembly for use at the nip between a dryer fabric and a dryer bottom roll at a location at which the fabric moves onto the roll and at which the web to be dried is outside the fabric. A shroud having first and second walls which diverge from a nose is assembled with a plenum chamber body having downwardly converging walls with an opening between the lower ends. The upper edge of one wall of the shroud is secured to one wall of the body to form a first plurality of orifices with the nose of the shroud below the opening and with the other wall of the shroud extending upwardly along and in spaced relation to the other wall of the body. One edge of a baffle extending across the body opening is secured to the one wall of the shroud with the other edge of the baffle connected to the other body wall at a location below the upper end of the other shroud wall to form a second line of orifices.

11 Claims, 4 Drawing Figures

Fig 1
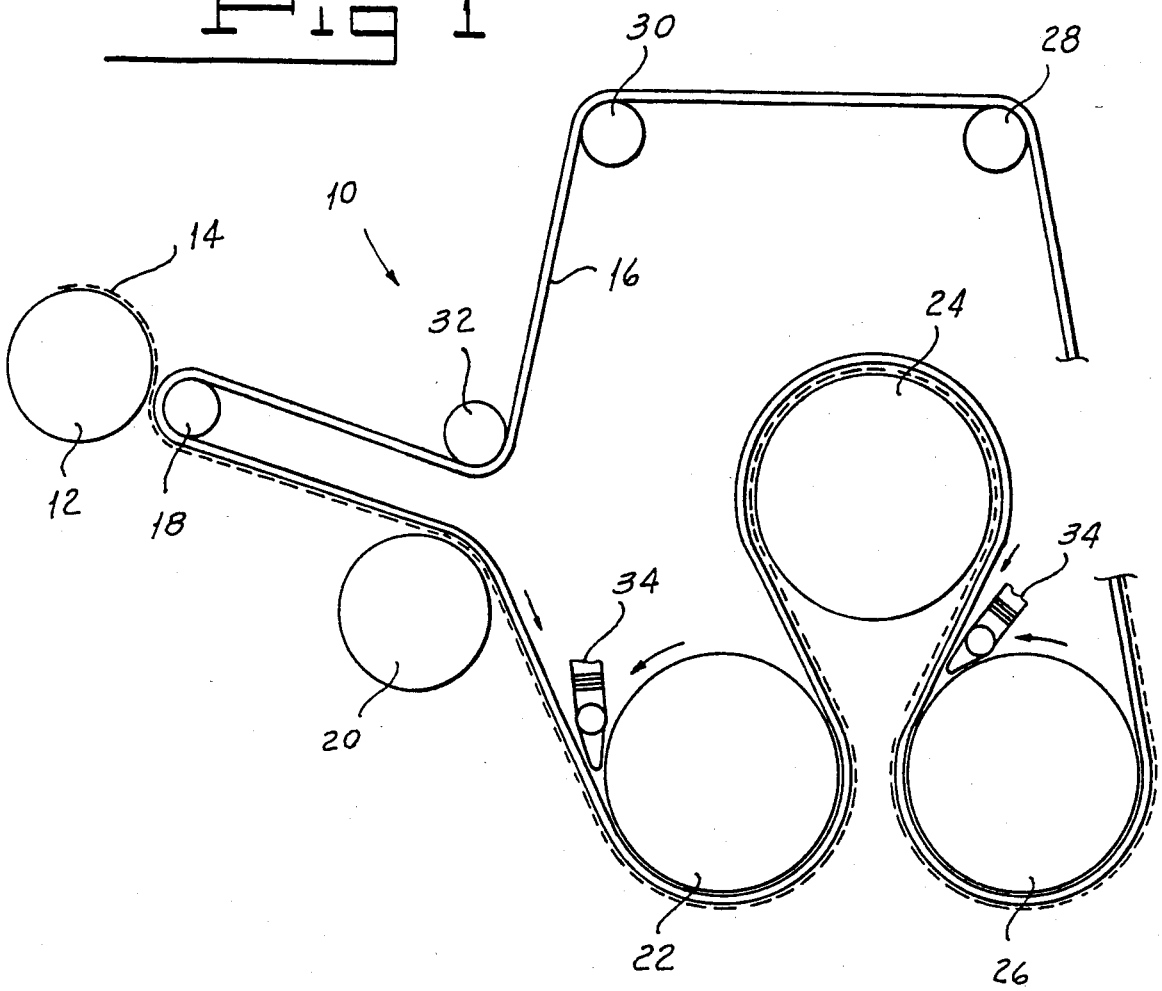
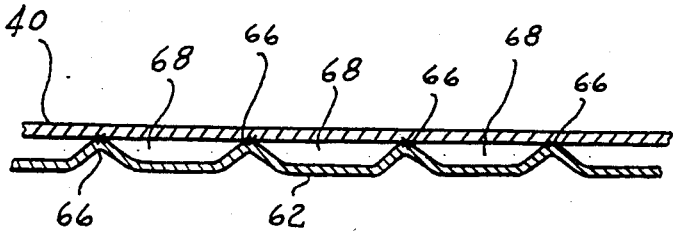
Fig 4

AIR SEALING NOZZLE FOR HIGH SPEED DRYER

RELATED APPLICATION

This application is a continuation-in-part of my copending application Ser. No. 732,935 filed May 13, 1985 now abandoned.

FIELD OF THE INVENTION

The invention relates to the field of high-speed paper machine dryers and, more specifically, to a nozzle for sealing certain nips of such a dryer to prevent a buildup of air pressure thereat.

BACKGROUND OF THE INVENTION

In conventional paper dryers of the prior art, respective upper and lower felts are guided around upper and lower dryer rolls by felt rolls. In the course of a drying operation on such a conventional dryer unit, the paper web to be dried is sandwiched between the felts and the dryer rolls but is unsupported in the region in which it passes from a lower dryer roll to an upper dryer roll and vice versa. While such a dryer unit provides an efficient drying, it is not capable of as high speed operation as is desirable owing to the presence of the "draws"or regions in which the paper web is unsupported as it passes between the upper and the lower dryer rolls.

Recently there have come into use "unifelt" or "serpentine" dryer units in which a single endless felt is trained around upper and lower dryer rolls and associated guide rolls. Dryer sections of this type are capable of operating at speeds in excess of 200 feet a minute owing to the fact that the paper web is supported by the felt or fabric over substantially the entire extent of the dryer.

While the "unifelt" dryer units of the type described hereinabove are capable of high speed operation, they incorporate a number of defects. One of these defects is a buildup of air pressure at the nip between the felt and a dryer roll at a location at which the felt is moving toward the roll. Owing to the high surface velocity of the fabric or felt as it approaches this nip, it entrains a relatively large amount of air and causes a buildup of pressure at the nip. At a location on the dryer at which the paper web is relatively below the fabric at such a nip, the buildup of pressure causes a bubble to develop between the fabric and the paper web. At a later point in the drying operation, such a bubble results in a crease or overlapping which produces a defect.

Attempts have been made in the prior art to solve the problem outlined hereinabove of pressure buildup at the nip between the fabric and the dryer roll. Such efforts have not been as successful as is desirable. They may require relatively expensive and cumbersome ducting to reach the points at which the pressure buildups occur. They involve the danger that loosened fasteners or the like may fall into the nip with the consequent damage, not only to the paper web being formed, but also to the expensive machine fabric or felt.

SUMMARY OF THE INVENTION

One object of my invention is to overcome a problem existing in high speed unifelt dryers of the prior art.

Another object of my invention is to provide an improved sealing nozzle for preventing pressure buildup at the nip between the fabric and a bottom dryer roll at a location at which the fabric is approaching the roll.

Still another object of my invention is to provide an improved sealing nozzle which obviates the possibility of loosened fasteners and the like falling into the nip between the fabric and the dryer roll.

Yet another object of my invention is to provide an improved air sealing nozzle which overcomes the defects of devices of the prior art directed to the solution of the same problem.

Other and further objects of my invention will appear from the following description.

BRIEF DESCRIPTION OF THE DRAWINGS

In the accompanying drawings to which reference is made in the instant specification and which are to be read in conjunction therewith and in which like reference characters are used to indicate like parts in the various views:

FIG. 1 is a partially schematic view of a high speed dryer provided with my air sealing nozzle.

FIG. 4 is a fragmentary sectional view of my air sealing nozzle taken along the line 4—4 of FIG. 2.

DESCRIPTION OF THE PREFERRED EMBODIMENT

Figure 2:
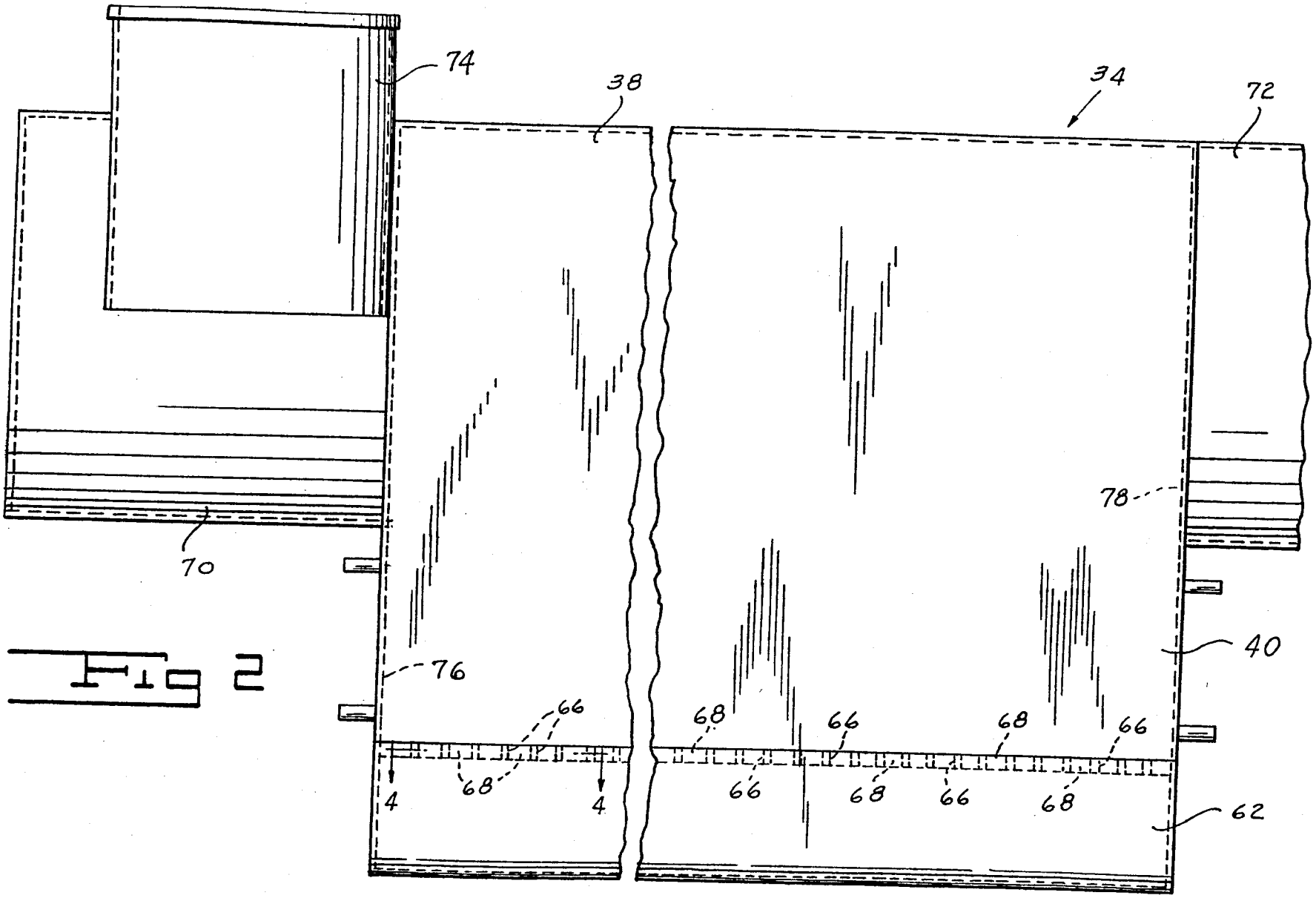
FIG. 2 is a top plan view of my air sealing nozzle with parts broken away.

Referring now to the drawings, a dryer section indicated generally by the reference character 10 with which my nozzle may be used, receives a paper web 14 from the last press roll 12 at the wet end of the paper making machine. The section 10 includes a fabric 16 extending around a suction roll 18 to a baby dryer 20, around a first bottom dryer 22, around a first top dryer roll 24, and around a second bottom dryer roll 26. From the roll 26 the felt 16 may be guided back to the suction roll 18 by means of a pair of top return rolls 28 and 30 and the guide roll 32.

The dryer section 10 which is known as a "unifelt" or "serpentine" dryer section is adapted to run at high speeds of the order of 2,000 feet per minute. Owing to this relatively high speed, the fabric or felt 16 which is relatively rough carries along a large volume of air. As this air enters into the nip between the bottom dryer roll 22, for example, and the fabric 16 it creates a pressure buildup. This pressure buildup results in a passage of air through the felt 16 to cause a bubble to form in the web 14. It will readily be appreciated that this problem is particularly severe where a relatively fine paper, such as writing paper, is being made since such paper is very full in the sense that it has a low degree of porosity. Such a bubble would travel around until it entered into the nip between the upper dryer roll 24 and the fabric, at which time it would be crushed so as to result in the type of defect discussed hereinabove.

It will readily be appreciated that the problem of such nip pressure bubbles exists only at the lower dryer rolls 22 and 26, whereat the paper web is outside the fabric or felt 16.

I provide dryer rolls 22 and 26 with my air sealing nozzle indicated generally by the reference character 34 at the two locations at which the pressure buildup problem exists. This is done for perhaps the first two or three lower rolls as required.

Figure 3:
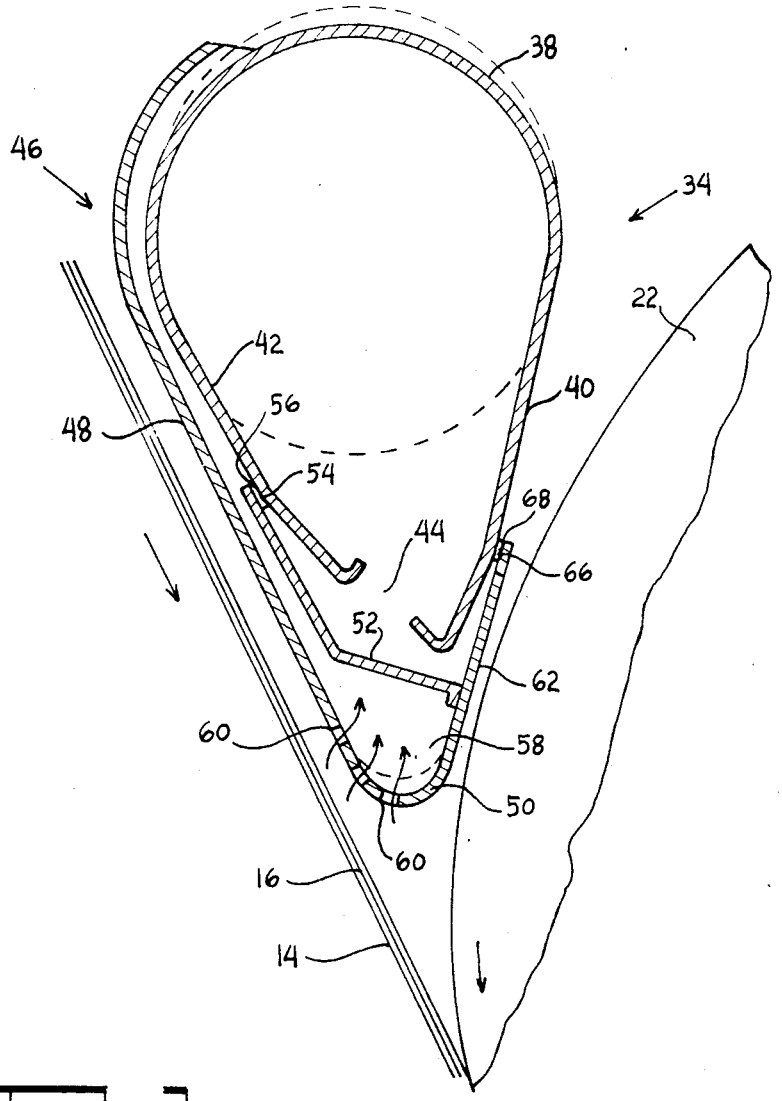
FIG. 3 is a sectional view of my air sealing nozzle for a high speed dryer showing its relationship to the dryer fabric and one of the dryer rolls.

Referring now to FIGS. 2 to 4 each unit 34 includes a plenum chamber body formed by a generally cylindrical upper wall 38 and converging side walls 40 and 42, the lower ends of which are separated to form a mouth 44 leading into the plenum chamber.

A shroud, indicated generally by the reference character 46 located between the wall 42 and the paper web 66 has a wall 48 extending downwardly to a nose 50 disposed adjacent to the nip between the web 16 and the roll 22. A wall 62 extends upwardly from nose 50 to a location above and outside of the lower end of wall 40. I form the upper edge of wall 62 with a plurality of dimples 66 spaced therealong. I then weld the dimples 66 to the outer surface of wall 40 to form a plurality of spaced passages 68.

I secure one edge of a partition 52 to the inner surface of wall 62 at a location below the lower end of wall 40. I form the edge of partition 52 remote from wall 40 with a plurality of spaced dimples 54 welded to the outer surface of wall 42 above the lower end thereof to form a plurality of passages 56. It will be seen that partition 52 extends across opening 44 to form a chamber 58 inside nose 50. A plurality of holes 60 provide communication between the space below the nose 50 and the chamber 58.

Respective generally cylindrical end extensions 70 and 72 on the unit 34 provide a means which facilitates support of the unit in the proper position on the machine. An inlet 74 is adapted to conduct heated air from the paper machine ventillating unit to the interior of the unit 34. End seals 76 and 78, welded into place, complete the unit 34.

Preferably I adjustably mount each of the units 34 so as to permit it to be moved between the full line position illustrated in FIG. 3 and the broken line position shown therein.

In one particular installation, the dimples 66 are one inch apart and the spacing of the wall 62 from the wall 40 is such as to provide a one-eighth inch gap. Dimples 54 are similarly arranged. Moreover, I so arrange my device as to provide a spacing between the felt or fabric 16 and the outer surface of the wall 48 which is between $\frac{1}{4}$ inch and $\frac{3}{4}$ inch. At the same time, the spacing between the outer surface of wall 62 and that of the dryer roll 22 is between $\frac{1}{2}$ inch and one inch. Moreover, in a typical installation the air coming out of the nozzle 68 is coming out at about 6,000 feet a minute while the dryer cylinder 22 is rotating at about 2500 ft. a minute. This reverse flow develops a negative pressure below the nozzles 68. At the same time the flow of air through nozzles 56 develops a negative pressure in chamber 58. Openings 60 permit the flow of air from the region of the nip between the fabric 16 and the roller 22 further to protect the buildup of pressure in this region. As a result the web 14 is drawn against the felt and, in operation of the machine, you can actually see a line on the felt. The upper end of the shroud wall 48 may be shaped to direct exiting air away from the web.

It will be seen that I have accomplished the objects of my invention. I have provided a nozzle which overcomes a problem in high speed dryers. My nozzle effectively prevents pressure buildup at the nip between the fabric and a bottom dryer roll at a location at which the fabric approaches the roll. Owing to the construction of my nozzle, the danger of loosened fastening elements falling into the nip is obviated.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a dryer section of the type having a single continuous fabric which forms a nip with a lower dryer roll as it moves into contact therewith at a location at which the paper web is outside the fabric, an assembly including an elongated body having a nose formed by a pair of sides diverging in a direction away from said nose, means mounting said body in operative relationship with a dryer section with said nose adjacent to said nip and with a first side of said body adjacent to said fabric and a second side of said body adjacent to said dryer roll, means for reducing the pressure of air within said nose and means in said first side providing communication between the region outside said nose and adjacent to said nip and the inside of said nose to produce a negative pressure effect in the region of said nip.

2. An assembly as in claim 1 including means in said second side of said body forming a line of closely spaced orifices for directing jets of air rearwardly of said nose and means for supplying air under pressure to said orifices to produce said jets adjacent to said lower dryer roll and in a direction away from said nip to enhance said negative pressure effect.

3. An assembly as in claim 2 in which said orifice forming means comprises a first wall portion having a plurality of dimples formed therein, a second wall portion, and welds securing said dimples to said second wall portion.

4. An assembly in claim 1 in which said means for reducing the pressure within said nose comprises means within said body forming a line of closely spaced orifices for directing air rearwardly of said nose and for exhausting said air in a direction away from said nose.

5. An assembly as in claim 4 in which said orifice forming means comprises a first wall portion having a plurality of dimples formed therein, a second wall portion and welds securing said dimples to said second wall portion.

6. An assembly as in claim 1 including means in said second side of said body forming a line of closely spaced orifices for directing jets of air rearwardly of said nose and means for supplying air under pressure to said orifices to produce said jets adjacent to said lower dryer roll and in a direction away from said nip to enhance said negative pressure effect, said means for reducing the pressure within said nose comprising means within said body forming a line of closely spaced orifices for directing air rearwardly of said nose and for exhausting said air in a direction away from said nose.

7. An assembly as in claim 6 in which each of said orifice forming means comprises a first wall portion having a pair of dimples formed therein, a second wall portion, and welds securing said dimples to said second wall portion.

8. In a dryer section of the type having a single continuous fabric which forms a nip with a lower dryer roll as it moves into contact therewith at a location at which the paper web is outside the fabric, an assembly including a nozzle having a bottom and a pair of sides diverging away from said bottom, each of said sides comprising means forming a line of closely spaced orifices for directing jets of air rearwardly of said bottom, means mounting said nozzle with said bottom adjacent said nip and with a first side adjacent said fabric and a second side adjacent said roll, a shroud extending from said second side around said bottom to form a nose and upwardly between said first wall and said orifices therein, means in said shroud providing communication between the region adjacent said nip outside said nose and the interior of said nose and means for supplying air to said nozzle to produce first jets of air through said first wall orifices to reduce the pressure within said nose and to produce second jets of air through said second wall orifices to produce a negative pressure in the region of said nip.

9. An assembly as in claim 8 in which each of said orifice forming means comprises a first wall portion having a pair of dimples formed therein, a second wall portion, and welds securing said dimples to said second wall portion.

10. In a dryer section of the type having a single continuous fabric which forms a nip with a lower dryer roll as it moves into contact therewith at a location at which the paper web is outside the fabric, an assembly including a plenum chamber body having a pair of walls converging downwardly toward the lower ends thereof with an opening between said ends, a shroud having a nose portion and a pair of upwardly diverging walls, means connecting the upper end of one of said shroud walls to one of said body walls to form a first line of closely spaced orifices, said nose being disposed below said opening and said other shroud wall extending upwardly along and in spaced relation to the other body wall, a baffle disposed between said opening and said nose, means connecting one edge of said baffle to said first shroud wall, means connecting the other edge of said baffle to said other body wall at a location below the upper end of the other shroud wall to form a second line of closely spaced orifices, means mounting said assembly in operative relationship with said dryer section with said nose adjacent to said nip and said first row of orifices adjacent to said roll and said other shroud wall adjacent to said fabric, means providing communication between the region of said nip and the interior of said nose and means for supplying air under pressure to said plenum chamber to cause said second line of orifices to produce jets of air directed away from said nose to reduce the pressure within said nose and to cause said second line of orifices to produce jets of air directed away from said nose adjacent to said roll to produce a negative pressure in the region of said nip.

11. An assembly as in claim 10 in which said orifice forming means comprises dimples formed in one of the two walls forming said orifices and welds connecting said dimples to the other of the two walls forming said orifices.

* * * * *